US005751319A

United States Patent [19]

Robertson et al.

[11] Patent Number: 5,751,319

[45] Date of Patent: May 12, 1998

[54] BULK INK DELIVERY SYSTEM AND METHOD

[75] Inventors: Larry W. Robertson, San Jose; Mark C. Fitzgerald, Mountain View, both of Calif.

[73] Assignee: Colossal Graphics Incorporated, Palo Alto, Calif.

[21] Appl. No.: 535,924

[22] Filed: Sep. 28, 1995

Related U.S. Application Data

[60] Provisional application No. 60/003,023 Aug. 31, 1995.

[51] Int. Cl.[6] ..... B41J 2/175

[52] U.S. Cl. ..... 347/85

[58] Field of Search ..... 347/6, 7, 8, 85, 347/86, 87, 103

[56] References Cited

U.S. PATENT DOCUMENTS 4,658,273 4/1987 Yuki et al. .
5,189,438 2/1993 Hine et al. .
5,369,429 11/1994 Erickson ..... 347/7
5,469,201 11/1995 Erickson et al. ..... 347/85
5,489,925 2/1996 Brooks et al. ..... 347/6
5,629,727 5/1997 Erickson ..... 347/85

*Primary Examiner*—Edward Tso
*Attorney, Agent, or Firm*—Beyer & Weaver, LLP

[57] ABSTRACT

A device and method for automatically replenishing ink to an ink cartridge is described. A supply ink reservoir is connected via a tubing device to a print ink container in the ink cartridge. The supply ink reservoir supplies ink to the cartridge while ink is being printed out of the print head of the cartridge. In one described embodiment, the supply ink reservoir is part of an ink container bottle that also includes a replenishing ink reservoir positioned above the supply ink reservoir. The replenishing and supply ink reservoirs communicate with each other through a passage which is controlled by a floating valve mechanism positioned within the supply ink reservoir. Thus, the floating valve mechanism is arranged to control the fluid level in supply ink reservoir at a substantially constant level. Thus, the print ink container is feed at a substantially constant pressure head, which facilitates good quality printing.

26 Claims, 5 Drawing Sheets

BULK INK DELIVERY SYSTEM AND METHOD

This application claims the priority of Provisional Application Ser. No. 60/003,023, filed Aug. 31, 1995, which is incorporated herein by reference in its entirety.

BACKGROUND OF THE INVENTION

The present invention relates generally to bulk ink delivery systems. More particularly, the present invention relates to methods and apparatus for feeding bulk ink to ink cartridges used in printers.

Large format ink jet printers are well known. Generally, a large format ink jet printer includes a supporting structure which supports a horizontal guide rail upon which a print carriage is slideably mounted. Ink jet cartridges (usually four in color printers) are supported by the print carriage which moves on the guide rail over a print platen. The print platen is also supported by the supporting structure, and is suitable for supporting the large format paper or material which is to be printed on with ink from the ink jet cartridges. The movement of the print carriage and the feeding or "jet-spraying" of ink from the jet cartridges are controlled in a known manner by a control unit so as to print a predetermined pattern on the paper or other print media which may also be controllably moved on the print platen.

One problem which exists with large format ink jet printers of this type is that the ink jet cartridges are quickly depleted of their relatively small quantities of ink, due to the fact that the print media is in a large format and therefore requires large quantities of ink for successful printing. Moreover, conventional disposable ink jet cartridges that are intended for use in both large and small format printers, are often depleted of their ink well before the useful life of the cartridges actually expires. In particular, the physical condition of an adequate number of ink printing ports or jets of the printing heads of such disposable ink jet cartridges are still acceptable enough to achieve a satisfactory printing result, even after all of the ink which has initially been provided in the cartridges is consumed due to printing. The disposal of these ink jet cartridges which are still able to perform adequately, except for the lack of ink in their supply containers, is wasteful. As will be appreciated by those skilled in the art, manual refilling of the ink supply containers of the ink jet cartridges requires great skill and effort, and it is also a messy task.

Accordingly, it has been proposed to provide ink reservoirs, containing larger quantities of ink and being arranged external to the ink jet cartridges. The external ink reservoirs are connected respectively to the ink supply containers of the ink jet cartridges in such a manner that ink is fed to the supply containers of the cartridges when ink is printed out of the print heads of the cartridges. Mechanical refilling systems including pumps and valves are known. However, such systems suffer from their relatively high complexity and cost.

U.S. Pat. No. 5,369,429 discloses an ink refill system for disposable ink jet cartridges which includes an ink reservoir container having a flexible ink bag containing replacement ink. Tubing connects the ink bag to the ink supply container of a cartridge for continuously transporting ink between the two by means of a pressure differential provided between the ink bag and the ink supply container of the cartridge. This system, including the ink reservoir container, the tubing, and the cartridge, is a completely sealed and self-contained system in which once the ink from the reservoir container is consumed, the system needs replacement with a new ink-filled and sealed system.

Moreover, the sealed system is configured such that the ink reservoir container is placed in a fixed height relationship with respect to the ink supply container of the cartridge, and as the level of fluid ink in the flexible bag of the ink reservoir container descends in response to printing, the pressure inside the ink supply container of the cartridge changes, consequently potentially negatively affecting the consistency of printing of the inkjet cartridge.

SUMMARY OF THE INVENTION

The present invention provides improvements in bulk ink delivery systems. According to one aspect of the invention, an ink delivery system for feeding ink to a print ink container of an ink jet cartridge is provided. The ink delivery system includes a supply ink reservoir containing ink to be fed to the print ink container of the cartridge. A tubing device is sealingly interconnected between the supply ink reservoir and the print ink container for conveying ink therebetween. An ink replenishing device supplies ink to the supply ink reservoir automatically in response to ink being delivered from the ink jet cartridge in order to substantially maintain the level of ink contained in the supply ink reservoir.

In one preferred embodiment, the ink replenishing device includes a replenishing ink reservoir arranged above the supply ink reservoir for supplying ink thereto through a passage by means of gravity, and a floating valve arranged for controlling the flow of fluid through the passage to maintain the level of ink in the supply ink reservoir at a substantially constant level.

In a method aspect of the invention, the ink supply reservoir is positioned at a fixed height differential relative to the ink cartridge such that an equilibrium between a surface level of the supply ink reservoir and the surface level of ink in the ink cartridge is maintained. A sealed liquid ink conveying path is provided between the reservoir of supply ink and the reservoir of print ink. Ink is then drawn through the conveying path from the reservoir of supply ink to the reservoir of print ink in response to printing from the cartridge, and the difference of fluid height between the surface levels of the supply and print ink reservoirs is maintained substantially constant by automatically replenishing fluid ink into the reservoir of supply ink.

Another preferred embodiment of the invention takes the form of an ink delivery system for automatically feeding bulk ink to a print ink container of an ink jet cartridge. The ink delivery system includes a supply ink reservoir, a tubing device sealingly interconnectable between the supply ink reservoir and the print ink container of the ink jet cartridge, a replenishing ink reservoir arranged above the supply ink reservoir for supplying ink thereto through an ink flow opening by means of gravity, and a floating valve assembly arranged inside the supply ink reservoir which includes a floating valve sealing element for floating in ink contained in the supply ink reservoir and arranged for engaging in the ink flow opening to control the flow of ink therethrough. By employing the replenishing ink reservoir and the floating valve assembly, the level of ink in the supply ink reservoir is advantageously kept substantially constant and the quality of printing of the ink jet cartridge is effectively maintained.

According to another aspect of the invention, a method for priming an ink delivery system is provided. The priming method includes the steps of sealingly interconnecting a tubing device between a supply ink reservoir and a print ink container of an ink jet cartridge, creating a sub-atmospheric pressure in the supply ink reservoir sufficiently to induce a flow of ink in the tubing device from the print ink container of an ink jet cartridge into the supply ink reservoir thereby priming the system. Thereafter, the sub-atmospheric pressure is removed from the supply ink reservoir allowing ink to flow from the primed supply ink reservoir to the ink cartridge.

BRIEF DESCRIPTION OF THE DRAWINGS

The invention, together with further advantages thereof, may best be understood by reference to the following description taken in conjunction with the accompanying drawings in which.

DESCRIPTION OF THE PREFERRED EMBODIMENTS

Figure 1A:
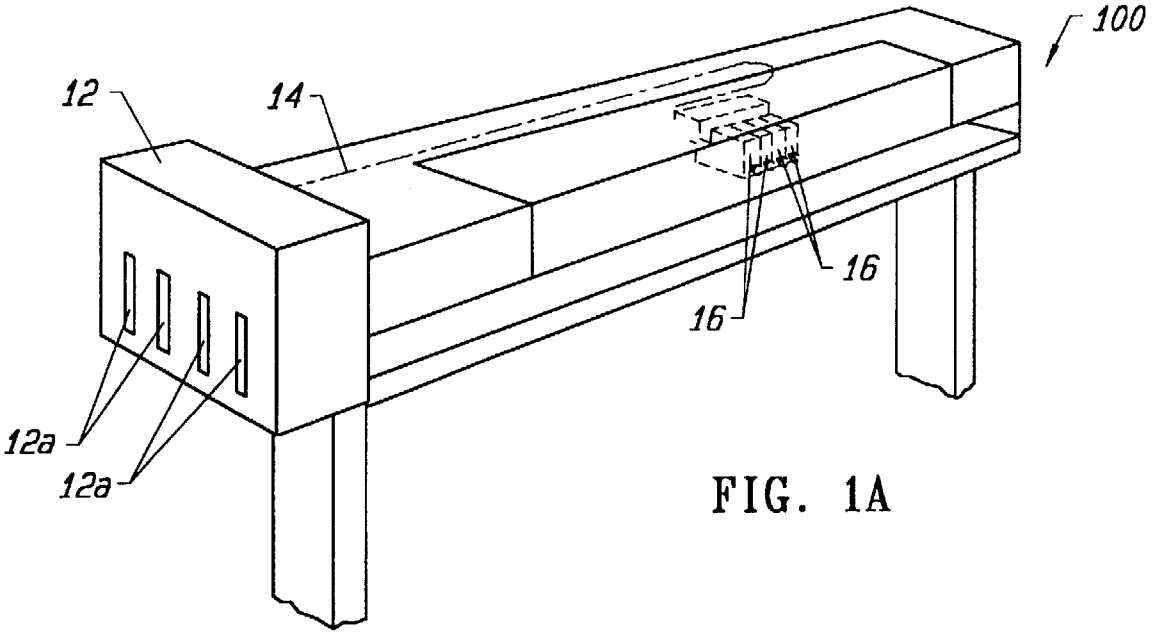
FIG. 1A is a perspective view of a bulk ink delivery system according to one embodiment of the present invention installed in a large format ink jet printer.

Reference is now made to the drawings, wherein like reference numerals denote like elements throughout the several views.

Figure 2:
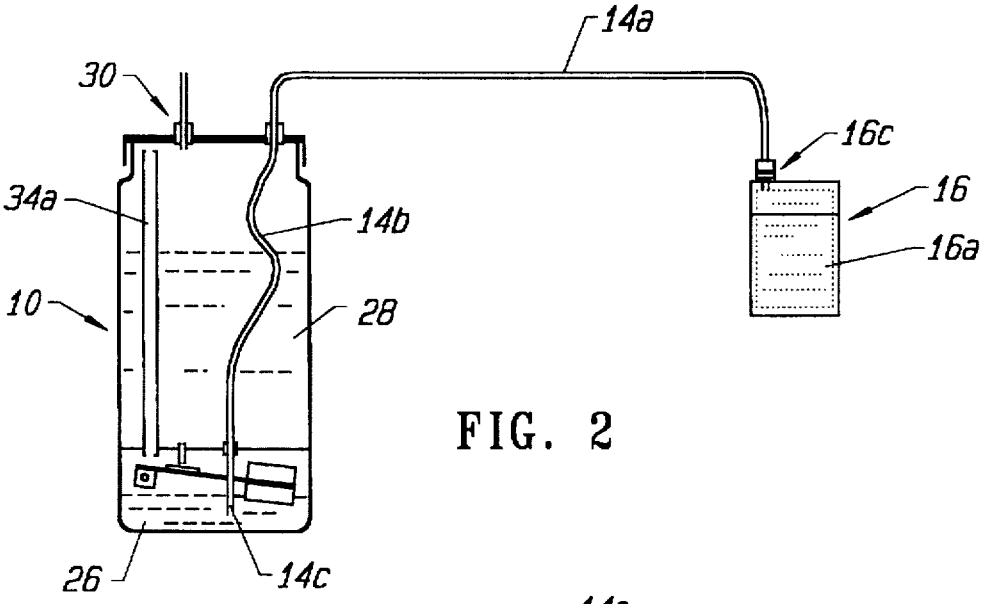
FIG. 2 is a schematic view of a bulk ink delivery system in accordance with the present invention.
Figure 3:
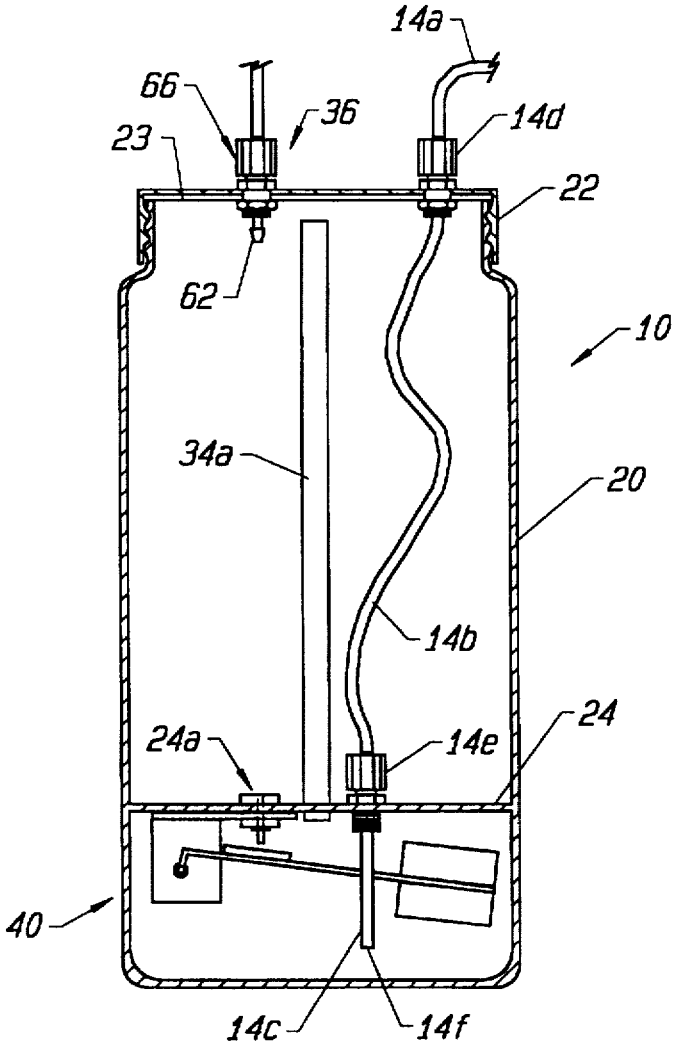
FIG. 3 is an elevational view of an ink container bottle of the bulk ink delivery system of FIG. 2.

Referring initially to FIGS. 2 and 3, a preferred embodiment of the bulk ink delivery system is shown. An ink containment bottle 10 is connected via tubing 14 to an ink cartridge 16. The containment bottle 10 includes a supply ink reservoir 26 and a replenishing ink reservoir 28. The tubing 14 makes a sealed connection between a print ink container 16 within the ink cartridge 16 and the supply ink reservoir 26. In this manner, the tubing 14 can provide a sealed path between the print ink container **16*a* and the supply ink reservoir 26. As ink is printed out of the cartridge 16, new ink is drawn from the supply ink reservoir through the tubing 14 to refill the print ink container 16*a***.

The replenishing ink reservoir 28 is positioned above the supply ink reservoir 26 and communicates therewith through an ink flow port **24*a*. A floating valve mechanism 40 is arranged in the supply ink reservoir for regulating the influx of ink through the ink flow port 24*a*. With this arrangement, as ink is drained from the supply ink reservoir 26 to supply the print ink container 16*a* in response to printing, the fluid level within the supply ink reservoir will drop. The float in floating valve mechanism 40 will then drop thereby opening the valve. This permits ink to flow from the upper replenishing ink reservoir 28 to the supply ink reservoir 26 through the ink flow port 24*a*. When the supply ink reservoir 26 is sufficiently replenished, the floating valve mechanism will automatically close the ink flow port 24*a***. Thus, the described bulk ink delivery system is arranged to automatically replenish ink in a supply ink reservoir substantially simultaneously while printing occurs. Ink may also be poured directly into a replenishing ink reservoir simultaneously while printing is taking place, thereby allowing for extended uninterrupted printing that is only limited by the reliability of the print cartridges themselves.

With the described arrangement, the fluid level in the supply ink reservoir is maintained at a substantially constant height. This maintains a substantially constant pressure head in the supply ink reservoir which can be balanced with the ink cartridge by mounting the ink containment bottle 10 at a designated height relative to the ink cartridge. Thus, the cartridge prints ink under the influence of a substantially fixed ink liquid head. As will be appreciated by those skilled in the art, in some types of cartridges such as HP ink jet cartridges, such control over the pressure head will provide more consistent quality printing than would otherwise be available.

Figure 1B:
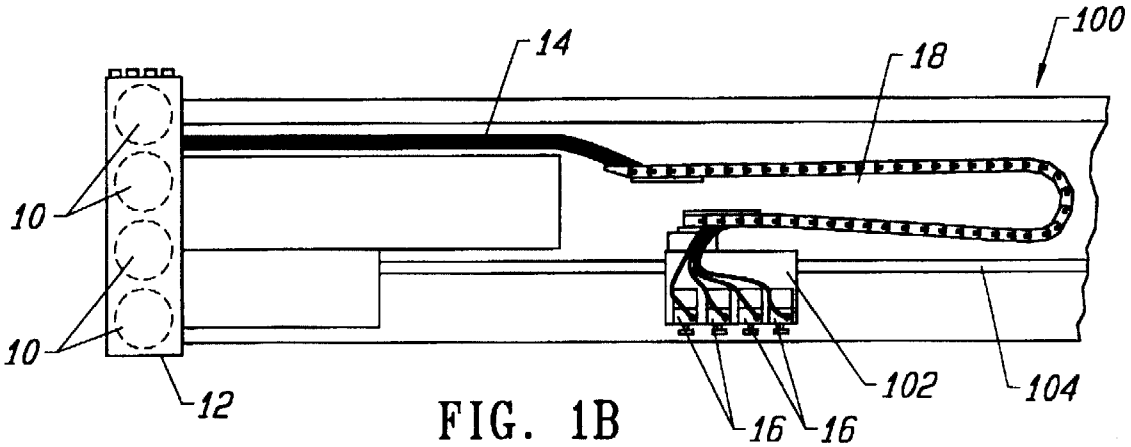
FIG. 1B is a partial plan view of the bulk ink delivery system of FIG. 1A.

Referring to FIGS. 1A and 1B, one embodiment of the bulk ink delivery system includes a plurality of ink containment bottles 10, a housing 12 for supporting the bottles 10 and for connection to a conventional large format ink jet printer 100, and tubing 14 for connecting each of the bottles 10 to a respective ink jet cartridge 16.

In a known manner, the printer 100 includes a carriage 102 which is controllably slideable on a horizontal guide 104 and which is adapted to support the ink jet cartridges 16. In the embodiment illustrated in FIG. 1B, four ink containment bottles 10 are connected via tubing 14 respectively to four ink jet cartridges 16, thereby to employ four ink "colors" (generally cyan, magenta, yellow, and black) for obtaining color printing, as will be appreciated by those skilled in the art. Thus each of the four bottles 10 is adapted to contain a respective ink color, and the housing 12 is provided with windows **12*a* which allow an operator to easily see the ink levels inside the bottles 10. Also in a known manner, a chain element 18 is provided for one-way bending in a horizontal plane in order to effectively guide the tubing 14 in the printer 100 as the carriage 102 slides on the guide 104. The chain element 18** may be for example an igus® series 05 plastic energy chain provided by Igus of Providence Rhode Island.

Referring again to FIGS. 2 and 3, one embodiment of the ink containment bottle 10 takes the form of a substantially cylindrical plastic bottle 20 provided with a screw-on lid 22 and an intermediate wall portion 24. The screw-on lid allows for access to the inside of the bottle 20 so that ink may be easily poured directly into the bottle 20. The screw-on lid 22 also allows for an essentially air-tight seal within the inside of the bottle 20 when it is tightly screwed-on. A circular rubber gasket 23 is useful for this purpose. The intermediate wall portion 24 separates the interior of the bottle 20 into a lower supply ink reservoir 26 and an upper replenishing ink reservoir 28. An ink flow port 24*a* is provided in the intermediate wall to allow ink to flow from the replenishing ink reservoir 28 to the supply ink reservoir 26 by means of gravity and under certain conditions which will be described hereinafter.

The tubing 14 includes a first plastic tube portion 14*a* sealingly connected at one end thereof to the print ink container 16*a* of the ink jet cartridge 16 and sealingly connected at another end thereof to a first port 14*d* provided on the lid 22 of the bottle 20. The tubing 14 further includes a second plastic tube portion 14*b* sealingly connected at one end to the first port 14*d* and sealingly connected at another end thereof to a second port 14*e* provided on the intermediate wall portion 24. The tubing 14 also includes a third plastic tube portion 14*c* having a first end sealingly connected to the second port 14*e* and having a second open end 14*f* which is arranged near the bottom of the lower supply ink reservoir 26, so that the open end 14*f* will be submerged in supply ink contained in the supply ink reservoir 26. The second tube portion 14*b* is sufficiently long to allow for easy screwing of the lid 22 on and off the bottle 20 without disconnecting the tubing.

The reference numeral 30 indicates a priming device of the bulk ink delivery system which will be discussed in more detail later with reference to FIGS. 6 and 7.

A floating valve arrangement or mechanism 40 is provided in the ink supply reservoir 26. The purpose of the floating valve mechanism 40 is to regulate the flow of ink from the upper replenishing ink reservoir 28 to the lower supply ink reservoir 26 through the ink flow port 24*a* of the intermediate wall 24. In particular, when the level of ink in the supply ink reservoir 26 is below a predetermined level, the floating valve mechanism opens thereby allowing ink to flow through the port 24*a* thereby increasing the level of ink in the supply ink reservoir 26 up to the predetermined level whereupon the floating valve mechanism 40 shuts off flow of ink through the port 24*a*. As ink is supplied to the print ink container 16*a* via tubing 14 from the supply ink reservoir 26 in response to printing of the ink jet cartridge 16, the level of ink in the supply ink reservoir 26 will begin to drop, whereupon the floating valve mechanism 40 opens to automatically refill the supply ink reservoir 26 with ink from the replenishing ink reservoir 28.

Figure 4:
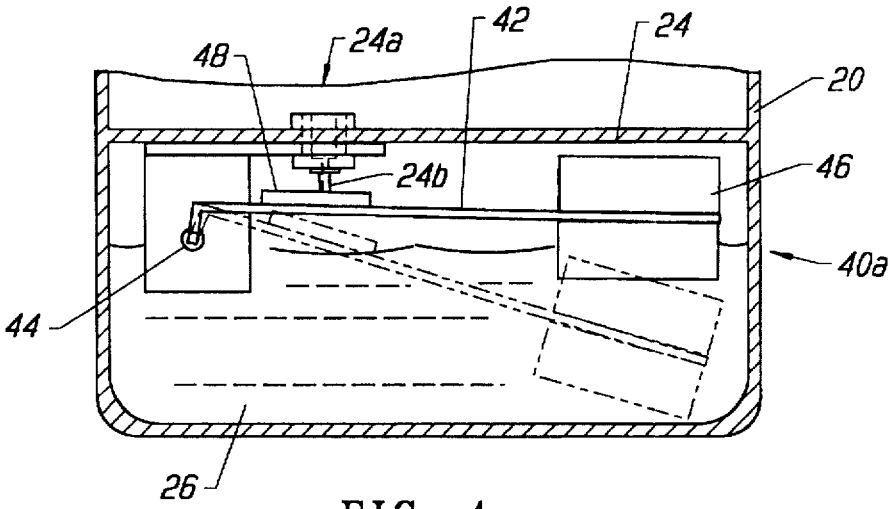
FIG. 4 is partial view of the ink container bottle of FIG. 3, showing a first embodiment of a floating valve arranged in a supply ink reservoir of the bottle.

FIG. 4 shows a first embodiment of the floating valve mechanism 40*a* which includes a rod member 42 pivotally connected at pivot connection 44 below the intermediate wall 24 such that the rod member pivots in a substantially vertical plane. A float 46, which may be formed from any suitable material that is non-reactive with conventional printing inks, is attached to the end of the rod member 42 distally from the pivot connection 44. By way of example, the float may be formed from neoprene. With this arrangement, the rod member 42 pivots in the vertical plane as the float 46 moves up and down with respect to the level of ink in the supply ink reservoir 26.

A valve sealing element 48, which by way of example may be made of natural rubber, is connected to the rod member 42 such that it faces upward and is arranged for alternately blocking and unblocking the flow of ink through the ink flow port 24*a*. To this end, the ink flow port is provided with a protruding tube valve seat portion 24*b* for engagement with the valve sealing element 48.

Figure 10:
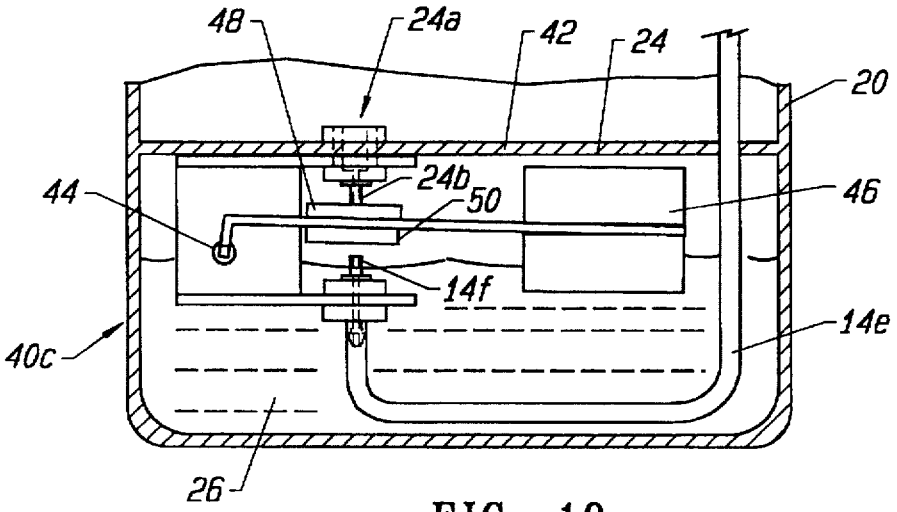
FIG. 10 is a partial view, similar to FIGS. 4 and 5, of a third embodiment of a floating valve arranged in a supply ink reservoir.

FIG. 10 illustrates an alternate embodiment of the floating valve mechanism 40*c* which is similar to the mechanism 40*a*, but which is further provided with a second valve sealing element 50, which also may be made of any suitable material such as natural rubber. The second valve sealing element 50 is connected to the rod member 42 such that it faces downwardly. In this embodiment, the end 14*f* of tube portion 14*e* comprises another protruding tube valve seat portion which is engaged by the second valve sealing element 50 when the level of ink in the supply ink reservoir decreases to a predetermined low level. In this manner, the danger of drawing air through the tube portion 14*e* to the print ink container 16*a* of the ink jet cartridge 16 (FIG. 2) when the ink in the supply ink reservoir 26 goes below a predetermined level is avoided and a sealed arrangement of the tubing 14, print ink container 16*a* and supply ink reservoir 26 is maintained.

Figure 5:
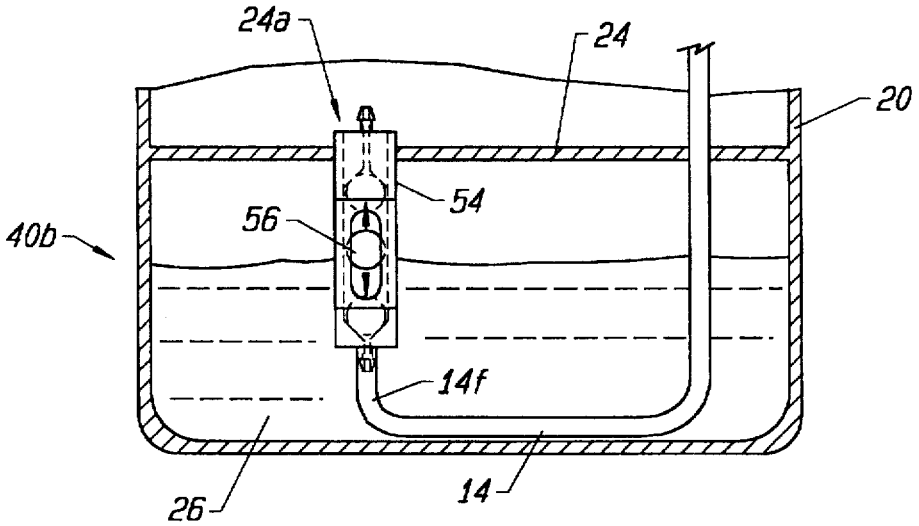
FIG. 5 is a partial view, similar to FIG. 4, showing a second embodiment of a floating valve arranged in a supply ink reservoir.

FIG. 5 illustrates another embodiment of the invention in which the floating valve arrangement 40*b* includes a vertically arranged cage-like column 54 connected below the intermediate wall 24 and extending into the supply ink reservoir 26. The column 54 includes an upper valve seat in communication with the ink flow port 24*a* and a lower valve seat in communication with the end 14*f* of the tubing 14. A float ball 56 is arranged inside the cage-like column 54 which allows for the float ball 56 to float with respect to the surface of supply ink contained in the supply ink reservoir 26. In this manner, the float ball 56 may engage the upper valve seat of the column 54 for blocking ink flow through the port 24*a* when the fluid level in supply ink reservoir 26 is sufficiently high. Alternatively ink may flow through the port 24*a* when the float ball is not engaged in the upper valve seat. Additionally, engagement of the float ball 56 in the lower valve seat of the cage-like column 54 prevents air from being drawn in the tubing 14 when the level of ink in the supply ink reservoir 26 falls to a predetermined low level.

Figure 6:
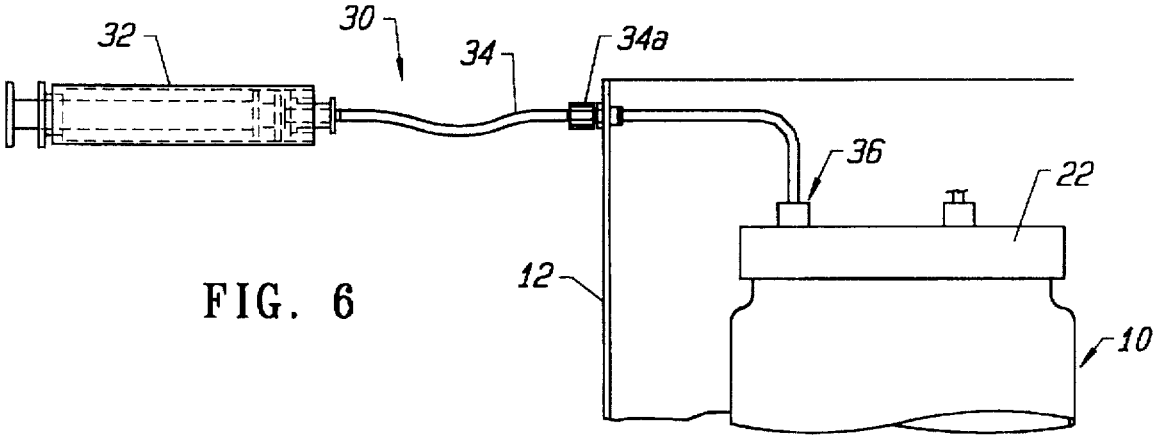
FIG. 6 is a schematic view of a priming device for the bulk ink delivery system according to the present invention.
Figure 7:
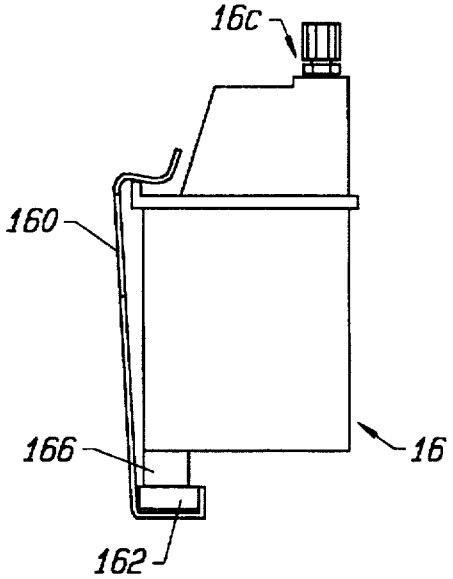
FIG. 7 is an elevational view of an ink jet cartridge and a metal clip for blocking the printing nozzles of the cartridge.

FIG. 6 illustrates one embodiment of a priming device 30 suitable for priming the bulk ink delivery system to create a sealed ink connection between the print ink container 16*a* and the supply ink reservoir 26. The described embodiment of the priming device 30 includes a syringe-like plunger 32 connected by means of priming tubing 34 to a priming port 36 provided in the lid 22 of the bottle 10. This arrangement makes it possible to vent the bottle and create a vacuum therein. An intermediate priming tubing 34*a* is provided (see FIGS. 2 and 3) to communicate with air pockets above the ink contained in the replenishing ink reservoir 28 and the supply ink reservoir 26 respectively.

One suitable method of priming the system is as follows. The nozzles of the print head of the ink jet cartridge and the lower air vents on the cartridge are securely sealed. FIG. 7 shows a metal cartridge clip 160 having a rubber cushion 162 which when snapped fly in place allows to seal off the cartridge nozzles of the print head 16*b*. Any vents of the cartridge should also be sealed except for the breather hole for the "lungs" in the cartridge. The vents to be sealed can be sealed by any suitable means, as for example by conventional tape. The tubing 14*a* is sealingly connected to the ink refill port 16*c* which communicates with the print ink container 16*a*. The system is preferably primed when the cartridge 16 is essentially full of print ink (although this is not a requirement).

With the lid 22 of the bottle 10 unscrewed, ink may be poured into the ink containment bottle 10 until ink is contained in both the supply ink reservoir 28 and the replenishing ink reservoir 26. The lid 22 is then screwed back onto the bottle 10 to seal the bottle 10. The syringe-like plunger 32 is then connected to the priming port 36 with the plunger fully depressed. By withdrawing the plunger, a vacuum is created inside the ink containment bottle 10 to draw ink from the print ink container 16*a* through the tubing 14*a* and into the supply ink reservoir 26 thereby to remove air in the tubing 14*a* and create a sealed delivery system. The plunger is then disconnected thereby to return the ink containment bottle 10 to atmospheric pressure.

Pinch clamps 38 are provided (see FIG. 12) for attachment to the tubing 14*a* in case air is still trapped in the tubing 14*a* after a first priming step thereby to allow successive priming steps by closing the clamps 38, removing the plunger 32 from the priming port 36, depressing the plunger and reconnecting it to the priming port, opening the clamps 38, and re-withdrawing the plunger 32. Priming of the system is required whenever the seal is broken in the delivery system, such as when a cartridge is changed or a tubing is unfastened.

Figure 11:
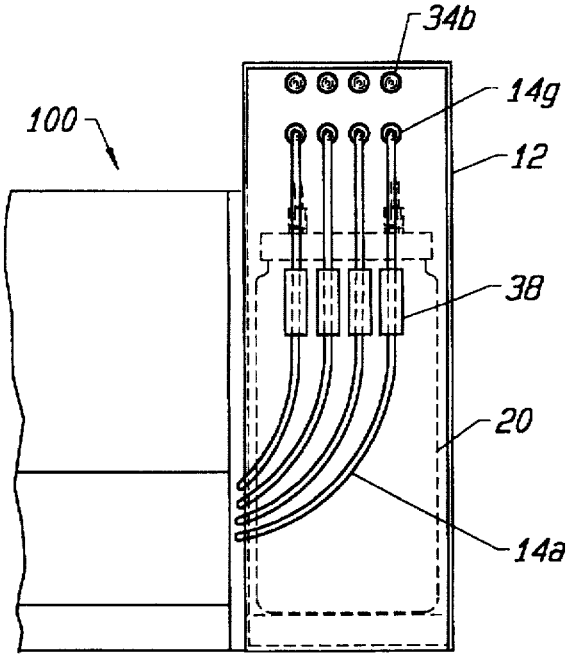
FIG. 11 is a rear elevational view of a housing of the bulk ink delivery system of the present invention, connected to a large format ink jet printer.
Figure 12:
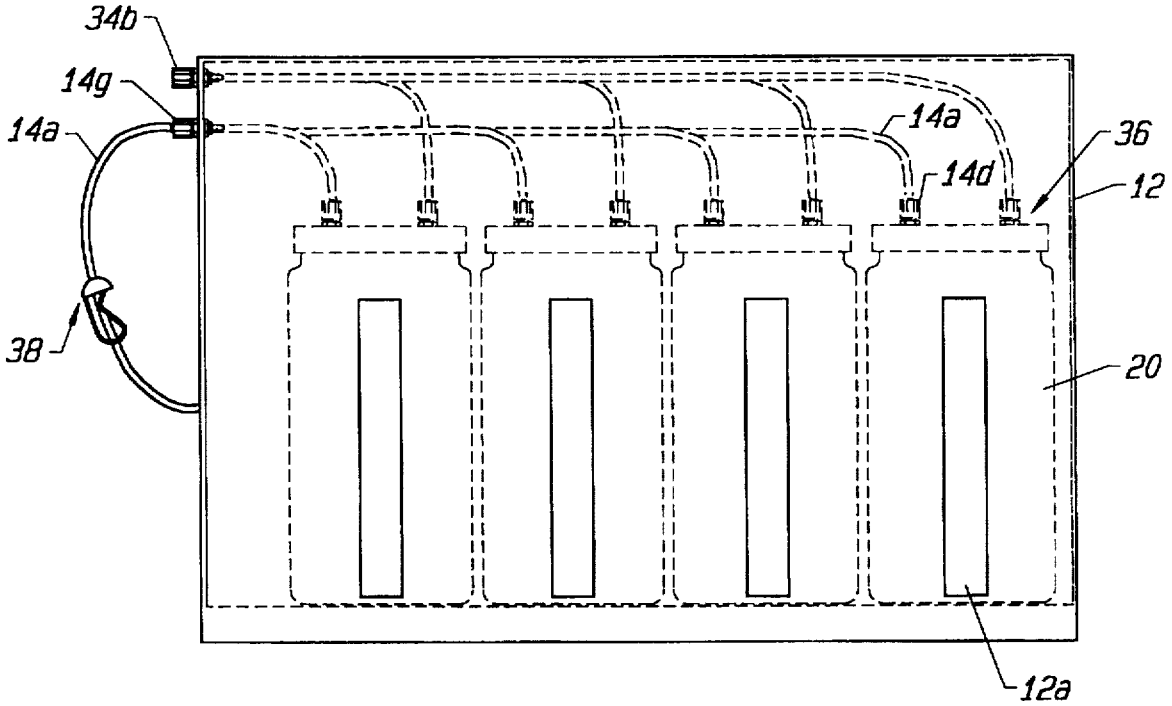
FIG. 12 is a side elevational view of the housing of FIG. 11.

FIGS. 11 and 12 illustrate the housing 12 which is connected to the side of the printer 100 and which supports ink containment bottles 10 of the bulk ink delivery system according to the invention. The housing 12 advantageously is provided with four box priming ports 34*b* and four box supply ink ports 14*g* which allow for an easy priming operation once the ink containment bottles 10 are placed in the housing 12 connected in the printer 100.

The housing 12 is connected to the printer 100 so that the equilibrium level of ink in the lower supply ink reservoir 26 (that is the level of the ink when ink flow through the ink flow port 24*a* becomes blocked as described above) of a containment bottle 10 supported by the box is in a predetermined relationship with respect to the level of ink in the print ink container 16*a* of the cartridge 16 supported by the carriage 102 of the printer 100. It is known that many conventional ink jet cartridges include print ink containers are maintained at a negative or sub-atmospheric pressure equivalent to about one inch of water for preventing ink leakage while not printing. The present invention therefore provides connection of the box 12 to the printer such that a height difference between the level of ink in the print ink container of the cartridge and the level of ink in the supply ink reservoir 26 at equilibrium is equal substantially to about one inch (given that the density of widely used inks is essentially equal to the density of water), thereby to maintain the design sub-atmospheric pressure of the ink jet cartridge. Of course, the actual height differential can be adjusted in accordance with the needs of a particular cartridge configuration.

Upon printing in which ink is delivered to the cartridge print head from the print ink container in a known manner, ink is drawn through tubing 14*a* to the print ink container 16*a* from the supply ink reservoir 26 to reestablish the equilibrium state. Printing takes place substantially from a fixed head of liquid ink in the print ink container 16*a* of the ink jet cartridge 16 which assures a consistently high quality printing. Substantially simultaneously while printing occurs, ink is drawn from the supply ink reservoir 26 to the print ink container 16*a* and ink is automatically replenished into the supply ink reservoir 26 by ink flow through the ink flow port 24*a* from the replenishing ink reservoir 28. An operator may view the ink level in the replenishing ink reservoir 28 and if needed, open the lid of the ink containment bottle and fill the replenishing ink reservoir 28 with ink even while the printing is taking place. Therefore, the present invention provides an effective way of allowing for uninterrupted printing, which is particularly important in large format printing operations where large quantities of ink are used in short periods of time.

Figure 8:
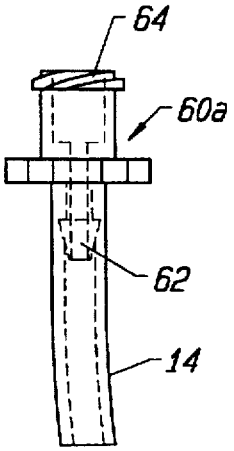
FIG. 8 is an elevational view of a first embodiment of a fitting used for connecting tubing of the bulk ink delivery system according to the present invention.
Figure 9:
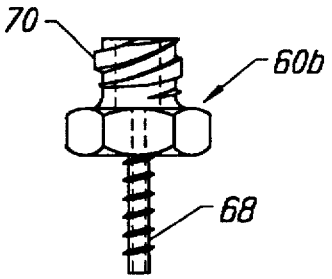
FIG. 9 is an elevational view of a second embodiment of a fitting used for connecting tubing in the invention.

In the described embodiments, the various tubing is provided with one sixteenth inch inside diameter flexible plastic tubing for non-capillary flow. FIGS. 8 and 9 illustrate fittings suitable for use in connecting the various tubing in the bulk ink delivery system. A first end of the barb fitting 60*a* has a barb end 62 for engagement into the inner surface of the flexible tubing 14. The second end of the barb fitting takes the form of a luer fitting 64 for connection to mating luer fitting (not shown) on the component to which the barb fitting is connected. The barb fitting 60*a* may be made from any suitable material such as plastic. A locking ring 66 (FIG. 3) may be positioned over the luer fittings as required to improve the seal of the connection. Of course, other fastener arrangements can be used as well.

FIG. 9 shows a fitting 60*b* which is particularly useful for engagement into the ink refill port 16*c* of a conventional cartridge, such as a 51626A cartridge available from Hewlett-Packard of Santa Clara, Calif. The fitting 60*b* includes a lower threaded portion 68 which is screwed into the ink refill port so as to dislodge a sealing ball in the refill port and connect the fitting 60*b* to the cartridge. The fitting 60*b* also includes a luer fitting 70 that is suitable for attachment to a mating luer fitting on the tubing 14*a*. The fitting 60*b* may be formed from any suitable material. By way of example, metal fittings work well since they are generally reusable.

Although only a few embodiments of the present invention have been described in detail, it should be apparent that the present invention may be embodied in many other specific forms without departing from the spirit or scope of the invention. For example, while a specific form of the ink containment bottle has been described in which the replenishing ink reservoir is provided directly above the supply ink reservoir, it will be understood by those skilled in the art that separately provided or vertically non-aligned replenishing and supply ink reservoirs may be used. Furthermore, while only one delivery tube has been shown connected between each supply ink reservoir and each cartridge, it is also contemplated that a single supply ink reservoir may supply a plurality of cartridges. Moreover, while a particular embodiment of the invention has been described for use in large format printers, the invention may be useful in smaller printers and in printers where the cartridge does not move on a carriage or remains substantially fixed. Therefore, the present examples are to be considered as illustrative and not restrictive, and the inventions not to be limited to the details given herein, but may be modified within the scope of the appended claims.

What is claimed is:

1. An ink delivery system for feeding ink to a print ink container of an ink cartridge, ink being contained in said print ink container for delivery to a print head of said ink cartridge, the ink delivery system comprising:

a supply ink reservoir containing ink to be fed to said ink container of said ink cartridge;

a tubing device sealingly interconnected between said supply ink reservoir and said print ink container of said ink cartridge for conveying ink between said supply ink reservoir and said print ink container; and an ink replenishing device for supplying ink to said supply ink reservoir automatically in response to ink being delivered from said print ink container to the print head of said ink cartridge and without breaking the seal of said tubing device so as to substantially maintain a level of ink contained in said supply ink reservoir.

2. The ink delivery system of claim 1, wherein said ink replenishing device includes an replenishing ink reservoir and a valve arrangement having a floating valve sealing element that regulates the delivery of ink from the replenishing ink reservoir to the supply ink reservoir.

3. The ink delivery system of claim 2, wherein:

the replenishing ink reservoir is arranged above said supply ink reservoir and an ink flow opening is provided in the bottom of said replenishing ink reservoir; and said valve arrangement comprises a float valve seat arranged at said ink flow opening, said floating valve sealing element being arranged for floating in the ink contained in said supply ink reservoir and for engaging said float valve seat thereby to stop ink flow through said ink flow opening when the ink in the supply ink reservoir reaches a predetermined level.

4. The ink delivery system of claim 1, wherein said print ink container of said ink cartridge is releasably sealed and maintained at sub-atmospheric pressure.

5. The ink delivery system of claim 4, wherein the sub-atmospheric pressure of said print ink container in its sealed state is substantially equivalent to one inch of water, and wherein a height differential between the level of ink contained in said supply ink reservoir and the level of ink contained in said print ink container of said ink cartridge is substantially equivalent to one inch.

6. The ink delivery system of claim 1, wherein said supply ink reservoir is releasably sealable and wherein the ink delivery system further comprises a venting device connectable to the inside of said supply ink reservoir for creating a vacuum in said supply ink reservoir when it is sealed, thereby to allow priming of the system when said supply ink reservoir is sealed by means of initially drawing ink from said print ink container through said tubing device and into said supply ink reservoir.

7. The ink delivery system of claim 3, wherein said supply ink reservoir together with said replenishing ink reservoir are releasably sealable, and wherein the ink delivery system further comprises a venting device connectable to the inside of said supply ink reservoir and said replenishing ink reservoir for creating a vacuum in said supply and replenishing ink reservoirs when they are sealed during an initial priming stage, thereby to allow priming of the system when said supply and replenishing ink reservoirs are sealed by means of initially drawing ink from said print ink container through said tubing device and into said supply ink reservoir.

8. The ink delivery system of claim 7, wherein said venting device comprises:

a tubing system communicating between the inside of said supply and replenishing ink reservoirs and the outside of said supply and replenishing ink reservoirs; and a syringe-like plunger connectable to said tubing system thereby for creating a vacuum in said supply and replenishing ink reservoirs.

9. The ink delivery system of claim 7, wherein said ink replenishing device further comprises a removable sealed cover for allowing replenishing liquid ink to be fed into said replenishing ink reservoir when said cover is removed.

10. The ink delivery system of claim 2, wherein said valve arrangement comprises:

a rod member hinged to the inside of said supply ink reservoir so that said rod member pivots about a substantially horizontal axis; and a floating member connected to said rod member apart from the hinge point of said rod member;

said floating valve sealing element being connected to said rod member.

11. The ink delivery system of claim 10, further comprising a replenishing ink reservoir arranged above said supply ink reservoir for supplying ink to said supply ink reservoir by means of gravity, an ink flow opening being provided in the bottom of said replenishing ink reservoir, said valve arrangement further comprising a float valve seat arranged at said ink flow opening, said floating valve sealing element arranged for engaging in said float valve seat thereby to stop ink flow through said ink flow opening when the floating member raises to a preset level in the supply ink reservoir.

12. The ink delivery system of claim 10, wherein said sealed tubing device comprises a delivery tube having an open end submerged in the supply liquid ink in said supply ink reservoir, and wherein the system further comprises a delivery tube valve element connected downwardly to said rod member and arranged for engaging said open end of said delivery tube for blocking flow of ink through said open end of said delivery tube.

13. The ink delivery system of claim 2, wherein said valve arrangement further comprises:

a cage-like column arranged vertically in said supply ink reservoir;

said floating valve sealing element being arranged for floating on the surface of ink in said supply ink reservoir and for moving vertically in said cage-like column.

14. The ink delivery system of claim 13, further comprising a replenishing ink reservoir arranged above said supply ink reservoir for supplying ink from said replenishing ink reservoir to said supply ink reservoir by means of gravity, an ink flow opening being provided in the bottom of said replenishing ink reservoir, said valve arrangement further comprising a float valve seat arranged at said ink flow opening, said floating valve sealing element arranged for engaging in said float valve seat thereby to stop ink flow through said ink flow opening when the ink level within the supply ink reservoir reaches a first designated level.

15. The ink delivery system of claim 13, wherein said sealed tubing device comprises a delivery tube having an open end submerged in the ink in said supply ink reservoir, and wherein said floating valve sealing element is arranged also for engaging said open end of said delivery tube for blocking flow of ink through said open end of said delivery tube when the ink level within the supply ink reservoir falls to a second designated level.

16. A method for automatically delivering liquid ink to a print ink container of an ink cartridge, a reservoir of print ink being contained in said print ink container for feeding to a print head of said ink cartridge, the method comprising the steps of:

providing a reservoir of supply ink to be fed to said print ink container, said reservoir of supply ink being arranged in a spatial arrangement with respect to said reservoir of print ink such that a difference of fluid height is defined between an equilibrium state surface level of said reservoir of supply ink and an equilibrium state surface level of said reservoir of print ink;

providing a sealed liquid ink conveying path between said reservoir of supply ink and said reservoir of print ink;

drawing fluid ink through said ink conveying path from said reservoir of supply ink to said reservoir of print ink in response to print ink being fed to said print head of said ink cartridge; and maintaining said difference of fluid height between the surface level of said reservoir of supply ink and the surface level of said reservoir of print ink substantially constant in response to said step of drawing fluid ink through said ink conveying path by automatically replenishing fluid ink into said reservoir of supply ink.

17. The method of claim 16, further comprising the steps of:

providing a reservoir of replenishing ink to be fed to said reservoir of supply ink by arranging said reservoir of replenishing ink above said reservoir of supply ink thereby for feeding fluid replenishing ink from said reservoir of replenishing ink into said reservoir of supply ink by means of gravity;

providing a replenishing ink flow path from said reservoir of replenishing ink to said reservoir of supply ink;

blocking said replenishing ink flow path so that fluid replenishing ink is not able to flow there through when said equilibrium state surface level of said reservoir of supply ink exists; and unblocking said replenishing ink flow path during said maintaining step so that fluid replenishing ink is able to flow there through by means of gravity from said reservoir of replenishing ink to said reservoir of supply ink when said equilibrium state surface level of said reservoir of supply ink does not exist thereby to automatically replenish fluid ink into said reservoir of supply ink.

18. The method of claim 17, wherein said step of providing a replenishing ink flow path comprises providing a replenishing ink flow path with an opening arranged above the surface level of said reservoir of supply ink, and wherein said blocking and unblocking steps are performed by means of a floating valve arranged for floating on the surface level of said reservoir of supply ink and arranged for engaging and disengaging said opening of said replenishing ink flow path depending upon the height of the surface level of said reservoir of supply ink.

19. The method of claim 16, wherein said step of providing a reservoir of supply ink comprises providing a releasably sealable reservoir of supply ink, and wherein the method further comprises the step of:

priming said reservoir of supply ink, said reservoir of print ink, and said sealed liquid ink conveying path by creating a vacuum in said reservoir of supply ink when said reservoir of supply ink is sealed thereby to draw fluid ink from said reservoir of print ink through said sealed liquid ink conveying path and into said reservoir of supply ink.

20. The method of claim 17, wherein said step of providing a reservoir of supply ink comprises providing a releasably sealable reservoir of supply ink, and wherein said step of providing a reservoir of replenishing ink comprises providing a releasably sealable reservoir or replenishing ink, the method further comprising the step of:

priming said reservoir of supply ink, said reservoir of replenishing ink, said reservoir of print ink, and said sealed liquid ink conveying path by creating a vacuum in both said replenishing ink reservoir and said reservoir of supply ink when both said replenishing and supply ink reservoirs are sealed thereby to draw fluid ink from said reservoir of print ink through said sealed liquid ink conveying path and into said reservoir of supply ink.

21. The method of claim 20, further comprising the step of blocking said print head of said ink cartridge thereby to avoid entry of air into said reservoir of print ink during said step of priming.

22. An ink delivery system for automatically bulk feeding ink to a print ink container of an ink cartridge, ink being contained in said print ink container for delivery to a print head of said ink cartridge, the ink delivery system comprising:

a supply ink reservoir for containing ink to be fed to said ink container of said ink cartridge;

a tubing device sealingly interconnectable between said supply ink reservoir and said print ink container of said ink cartridge for conveying ink between said supply ink reservoir and said print ink container;

a replenishing ink reservoir arranged above said supply ink reservoir for supplying ink from said replenishing ink reservoir to said supply ink reservoir by means of gravity, an ink flow opening being provided in said replenishing ink reservoir for flow of ink from said replenishing ink reservoir to said supply ink reservoir;

a floating valve assembly arranged inside said supply ink reservoir, said floating valve assembly comprising a floating valve sealing element for floating in ink contained in the supply ink reservoir and arranged for engaging with said ink flow opening thereby to stop ink flow through said ink flow opening.

23. The ink delivery system of claim 22, further comprising a venting assembly for creating a vacuum in said supply ink reservoir thereby to allow priming of the system by means of initially drawing ink from said print ink container through said tubing device and into said supply ink reservoir.

24. The ink delivery system of claim 23, wherein said venting assembly is also adapted for creating a vacuum simultaneously in said replenishing ink reservoir during priming.

25. In a bulk ink delivery system comprising: an ink cartridge with a print ink container containing ink for delivery to a print head of the ink cartridge; a supply ink reservoir containing ink to be fed to the ink container of said ink cartridge; a tubing device which is sealingly interconnected between said supply ink reservoir and the print ink container of said ink cartridge and which contains ink such that ink flows from said supply ink reservoir through said tubing device and to said print ink container in response to ink being printed out of said print head of said ink cartridge; the improvement comprising:

a replenishing device for automatically replenishing ink into said supply ink reservoir while ink is being printed out of said print head of the ink cartridge.

26. In a bulk ink delivery system comprising: an ink cartridge with a print ink container containing ink for delivery to a print head of the ink cartridge; a supply ink reservoir containing ink to be fed to the ink container of said ink cartridge; a tubing device which is sealingly interconnected between said supply ink reservoir and the print ink container of said ink cartridge and which contains ink such that ink flows from said supply ink reservoir through said tubing device and to said print ink container in response to ink being printed out of said print head of said ink cartridge; the improvement comprising:

automatically replenishing ink into said supply ink reservoir simultaneously while ink is being printed out of the print head of said ink cartridge.

* * * * *